United States Patent [19]

Wieland et al.

[11] Patent Number: 4,862,800

[45] Date of Patent: Sep. 5, 1989

[54] PLATE SKEWING ASSEMBLY

[75] Inventors: Erich G. Wieland, Würzburg; Willi R. L. Dörsam, Höchberg, both of Fed. Rep. of Germany

[73] Assignee: Koenig & Bauer Aktiengesellschaft, Würzburg, Fed. Rep. of Germany

[21] Appl. No.: 243,726

[22] Filed: Sep. 13, 1988

[30] Foreign Application Priority Data

Sep. 19, 1987 [DE] Fed. Rep. of Germany ..... 3731642

[51] Int. Cl.[4] ..... B41F 27/00; B41L 29/14

[52] U.S. Cl. ..... 101/415.1; 101/DIG. 36

[58] Field of Search ..... 101/415.1, 378, DIG. 36, 101/116, 126, 127.1, 128.1

[56] References Cited

U.S. PATENT DOCUMENTS 3,311,052 3/1967 Zeuthen ..... 101/415.1

3,583,318 6/1971 Stevenson ..... 101/415.1

FOREIGN PATENT DOCUMENTS 893343 10/1953 Fed. Rep. of Germany .

*Primary Examiner*—J. Reed Fisher

*Attorney, Agent, or Firm*—Jones, Tullar & Cooper

[57] ABSTRACT

A printing plate skewing assembly utilizes slidable coupling plates, carried in a groove on a plate cylinder. The coupling plates carry printing plate clamping and tensioning assemblies and are slidable through their connections to pivotable levers which are positioned at opposing ends of the plate cylinder groove.

4 Claims, 5 Drawing Sheets

PLATE SKEWING ASSEMBLY

FIELD OF THE INVENTION

The present invention is directed generally to a plate skewing assembly. More particularly, the present invention is directed to a plate skewing assembly for skewing printing plates. More specifically, the present invention is directed to an assembly for skewing printing plates on a plate cylinder of a rotary printing press. The printing plate is secured on the plate cylinder by a pair of generally parallel plate clamping and tensioning elements. Each of these plate clamping and tensioning devices is secured to a coupling plate. The coupling plates are slidably carried in a groove in the plate cylinder and can be moved in opposing directions by a pair of skewing levers to effect skewing of the printing plate on the plate cylinder.

DESCRIPTION OF THE PRIOR ART

In the field of rotary printing, it is often necessary to adjust the position of a printing plate or plates carried on the surface of a printing plate cylinder. The plate may need to be shifted laterally on the cylinder, circumferentially around the cylinder, or may need to be skewed or given a slight twist on the cylinder. Particularly in the field of multiple plate and cylinder printing, in which succeeding plate cylinders each print one color of a multi-color final product, it is important to be able to bring the several printing plates on the several cooperating printing plate cylinders into proper registry. As discussed above, one of the adjustments which a printing plate may need to undergo is a skew adjustment.

It is generally known in the prior art to provide assemblies that are useable to skew a printing plate on a plate cylinder's surface. German Patent No. 893,343 discloses a plate skewing apparatus with which a printing plate can be skewed on the plate cylinder. However, with this prior art plate skewing device, the printing plate can be pivoted only about a point located at approximately one-half the cylinder width. A skewed position is attained by laterally displacing the leading edge and trailing edge of the printing plate. However, as already noted, the skewing position is attainable only about a point located approximately in the middle of the cylinder width. No other pivot points are possible.

It will thus be apparent that there is a need for a plate skewing. The plate skewing assembly which will provide greater flexibility in plate skewing assembly in accordance with the present invention provide such a device and is a substantive advance in the art.

SUMMARY OF THE INVENTION

It is an object of the present invention to provide a plate skewing assembly.

Another object of the present invention is to provide a plate skewing assembly for a printing plate cylinder.

A further object of the present invention is to provide a plate skewing assembly for a printing plate cylinder of a rotary printing press.

Yet another object of the present invention is to provide a plate skewing assembly in which the plate is skewable about a selectable pivot point.

Still a further object of the present invention is to provdie a plate skewing assembly in which the printing plate is skewable about a pivot point and is fixed in the vicinity of a register mark.

Even yet another object of the present invention is to provide a plate skewing assembly which may be operated by hydraulic or pneumatic means.

As will be discussed in greater detail in the description of the preferred embodiments which are set forth subsequently, the plate skewing assembly in accordance with the present invention utilizes a pair of pivotable levers at either end of a groove which extends across the plate cylinder. These levers are jointed to coupling plates which are slidable axially in the groove by pivotal movement of the levers. These coupling plates, which are disposed generally parallel to each other in the groove, each carry a printing plate clamping and tensioning device. Thus axial movement of the coupling plates in opposing directions will effect a skewing of the printing plate or plates carried by the plate clamping and tensioning devices. The levers at either end of the groove are structured and pivotably mounted such that extension of their lines of actuation intersect at pivot points for the printing plates being skewed on the plate cylinder.

In the plate skewing assembly of the present invention, it is an advantage that a previously set peripheral and lateral register is defined by the register mark located in the vicinity of a plate pivot point, so that the peripheral and lateral register need not be adjusted to compensate for a skewing error. It is also possible to perform this during machine operation, which shortens the set up times.

It is not longer necessary, in skewing errors, to skew the entire plate cylinder and thus to accept a paralellogram-shaped deformation of the surface of the printed copy. Disadvantages in terms of bearing, gear wheels and roller settings are avoided, and moreover the axial thrust that was unavoidable in a skewed position of the plate cylinder is also avoided.

The plate skewing assembly in accordance with the present invention provides a device to quickly and readily adjust the skewing of a printing plate on a plate cylinder. This may be accomplished in a manner which is not disruptive of other plate adjustments and which can be done either manually or by remote means. This plate skewing assembly provides a device which is a significant advance in the art.

BRIEF DESCRIPTION OF THE DRAWINGS

While the novel features of the plate skewing assembly in accordance with the present invention are set forth with particularity in the appended claims, a full and complete understanding of the invention may be had by referring to the detailed description of the preferred embodiments, as are presented subsequently, and as illustrated in the accompanying drawings, in which:

DESCRIPTION OF THE PREFERRED EMBODIMENTS

Figure 1:
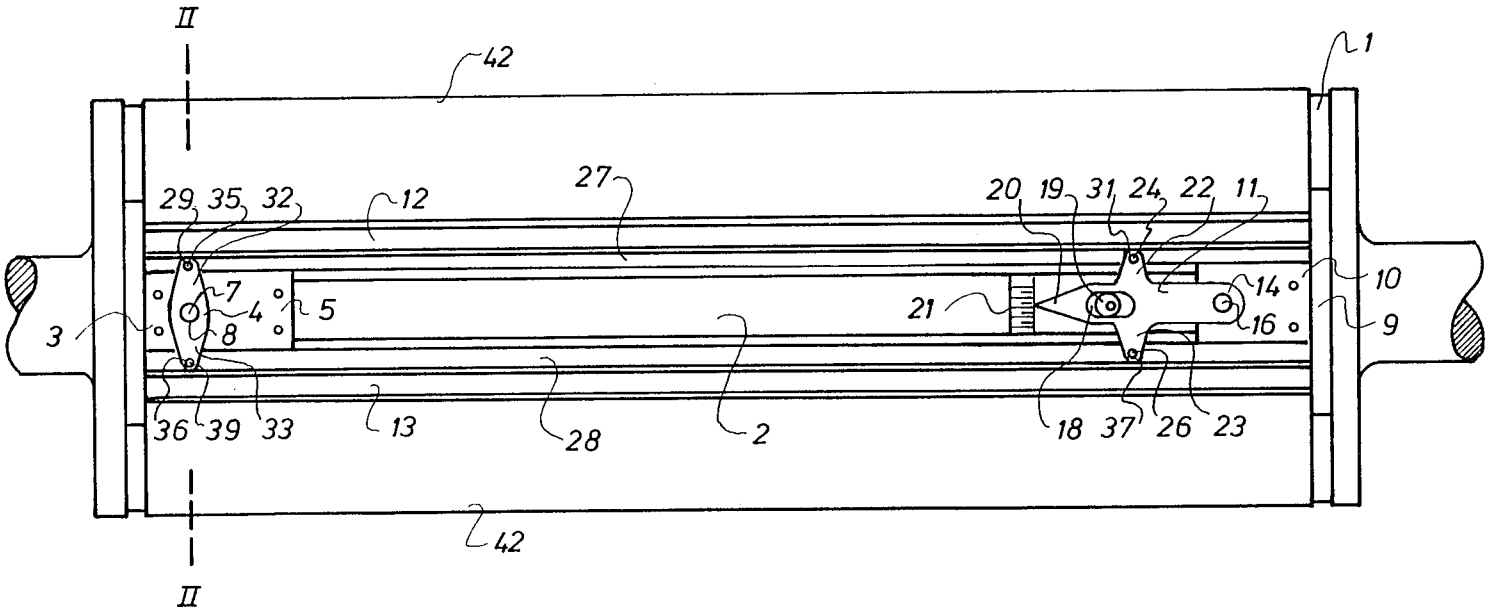
FIG. 1 is a top plan view of a first preferred embodiment of the plate skewing assembly in accordance with the present invention.

Referring initially to FIG. 1, there is shown a plate cylinder, generally at 1 for a rotary printing machine. Plate cylinder 1 has an axially extending groove 2 formed in its surface in a generally known manner. At the left end 3 of groove 2, as seen in FIG. 1, there is provided a pivotable two armed, one piece lever, generally at 4. This lever 4 is pivotally supported by a journal 7, as may be seen in FIGS. 1 and 2. Journal 7 is fitted into a holder 5 which is secured on the groove bottom 6. In its middle, the lever 4 has a bore 8 engaged by the journal 7. The bore 8, in the preferred embodiments shown, is disposed precisely in the middle of the one-piece lever 4. The one-piece embodiment of the lever 4 shown in FIG. 1 is practical, if skewing by a small angle, such as a pivot angle $\alpha = +0.8°$, equivalent to approximately +2 mm of plate skewing, is to be accomplished. If more extensive skewing must be compensated for, then the geometrical feature of a four-bar mechanism dictate that the lever 4 must be embodied in two parts, and in that case the two lever arms f and h, depicted schematically in FIG. 3, may be supported coaxially.

A second lever 11 is positioned at the right-hand end of the groove 2. Like the first lever 4, second lever 11 is rotatably supported about a journal 16 which is fitted into a holder 10. The holder 10 is secured to the groove bottom 6. The second lever 11 is, in the first preferred embodiment, in the form of a cross, which at its bottom, or right end has a bearing 14 for receiving the journal 16. At its top end, or left end, which is embodied as a pointertip 20, the cross-shaped lever 11 has an opening 18 which receives an eccentric 19. The pointer tip 20 is aimed at a scale 21 that is positioned transversely to the groove, and with the scale 21 serving as a display means for the skew adjustment. Rotation of the eccentric 19 causes pivoting of the second lever 11 about the journal 16 and thus skewing of the device carried by plate cylinder 1, such as printing plates 42. The lever 11 has two lever arms 22 and 23. These two lever arms 22 and 23 each have vertical bearing journals 24 and 26, respectively at their outer ends.

Figure 2:
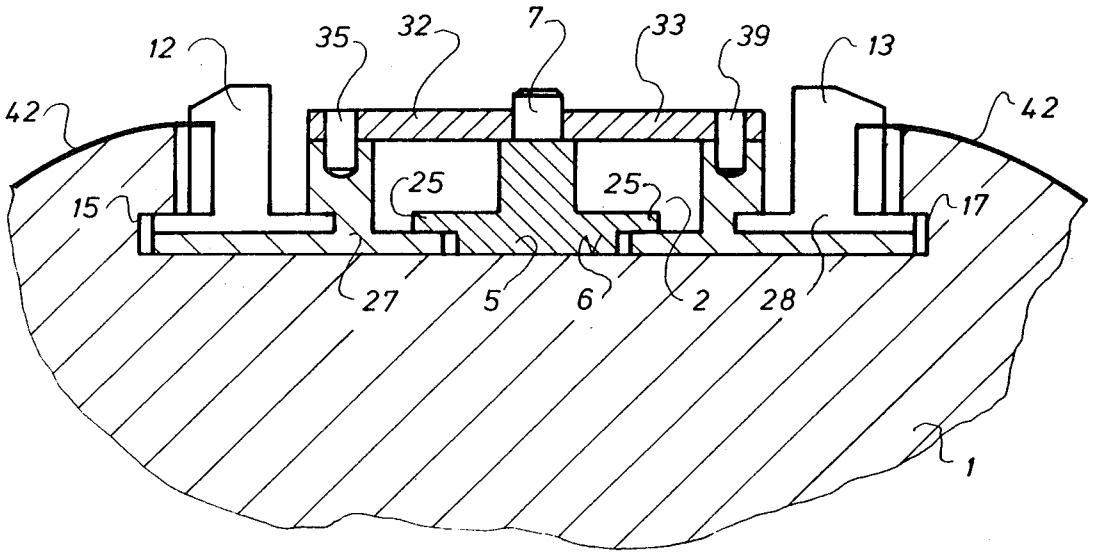
FIG. 2 is a sectional side elevation view of the plate skewing assembly taken along line II—II of FIG. 1.

Two coupling plates 27 and 28, which are each nearly as long as the groove 2, are positioned generally parallel to each other in the groove 2 on the groove bottom 6 in such a manner as to be slidable in all directions. An upper guide, which prevents coupling plates 27 and 28 from sliding out of the groove 2, is formed, as seen in FIG. 2 by lateral slots 15 and 17 in the groove side walls and by flanges 25 on the holders 5 and 10. The coupling plates 27 and 28 are slidably held in these guides with sufficient lateral play such that a displacement of plates 27 and 28 in the axial and circumferential directions is assured. Printing plate clamping and tensioning devices 12 and 13 are secured on the coupling plates 27 and 28. Then printing plate clamping and tensioning devices are generally conventional and need not be discussed in detail.

Figure 3:
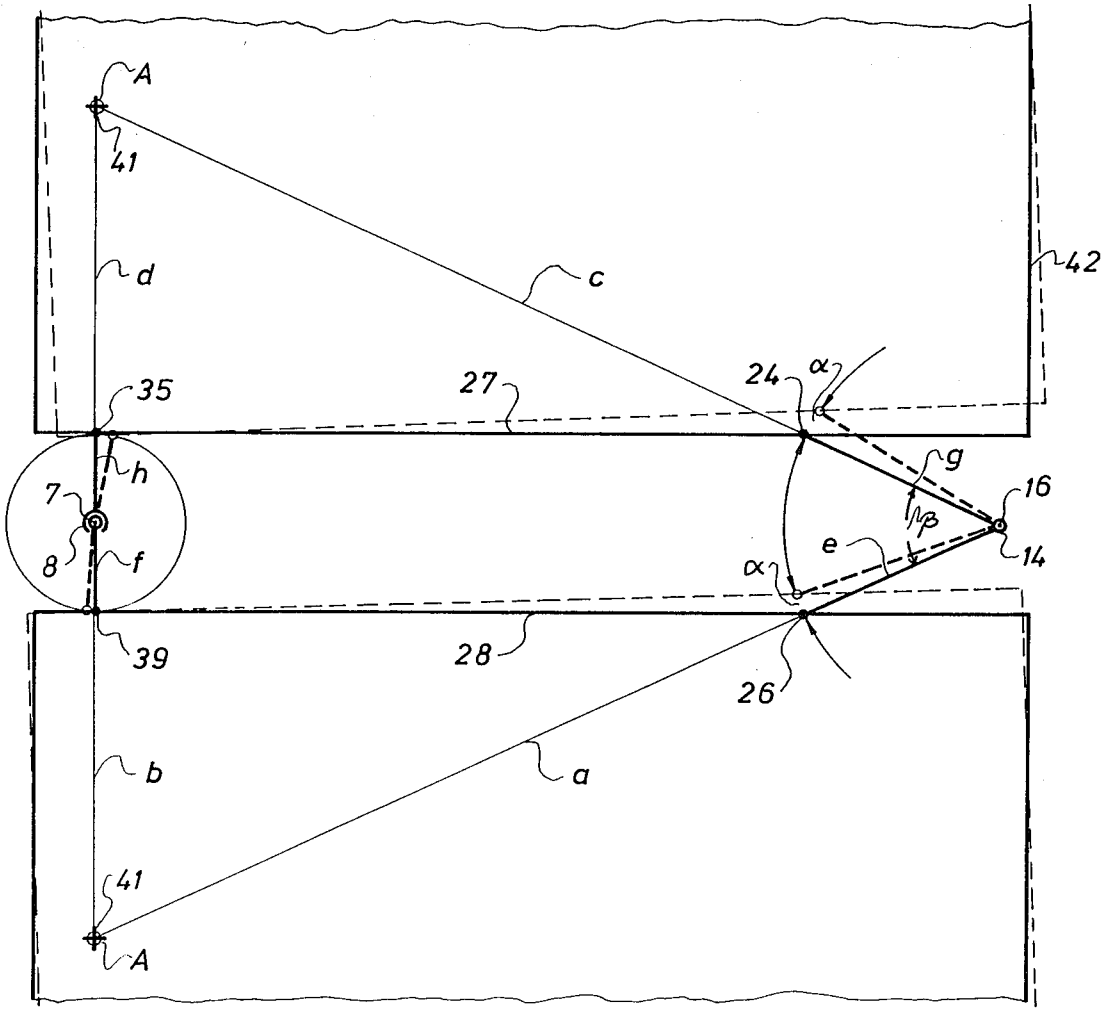
FIG. 3 is a schematic depiction of the levers of the plate skewing assembly and showing the lines of actuation, their extensions, and their intersections.

The coupling plate 27 is provided with two vertical bearing bores 29 and 31. The bearing bore 29 is engaged by a bearing journal 35 which is disposed on the end of a first arm 32 of the first lever 4. The second bearing bore 31 is engaged by the bearing journal 24 of the lever arm 22 of the second lever 11. The coupling plate 28 is similarly provided with vertical bearing bores 36 and 37. The bearing bore 36 is engaged by a bearing journal 39 disposed on the end of a second arm 33 of the first lever 4. The second bearing bore 37 is engaged by the bearing journal 26 of the lever arm 23 of the second lever 11. The levers 4 and 11 are structured such that the coupling plates 27 and 28 extend parallel to one another. Also, as seen in FIG. 3 extensions a, b, c, d of the connecting lines e, f, g, h intersect at a point A. Connecting line e indicates the line of actuation of connection formed between journal 16 at the right end of the second lever 11, and the journal 26 on lever arm 23. Connecting line f indicates the line of actuation or connection between journal 7 and the second arm 33 of the first lever 4. Connecting line g is similar to e but extends between journal 16 and journal 24 on the lever arm 22 of lever 11 which connecting line h is similar to f but extends between journal 7 and journal 35 on the first arm 32 of first lever 4. Depending on the structures of the first and second levers 4 and 11 the points of intersection A can be selected arbitrarily. However these points are preferably located in the vicinity of register marks 41.

To assure wrinkle-free skewing of a printing plate 42, clamped in place on the plate cylinder 1, a certain ratio X between the connecting lines e, f, g, h and their extensions a, b, c, d must be adhered to. The ratio X is as follows:

$$X = \frac{a+e}{e} = \frac{b+f}{f} = \frac{c+g}{g} = \frac{d+h}{h}$$

In order to skew the printing plate 42 on the plate cylinder 1, the eccentric 19 is rotated. The amount of rotation can be read off immediately by means of the position of pointer 20 on scale 21. The cross-shaped second lever 11 is pivoted by the eccentric 19 about the journal 16 and acts through its lever arms 22 and 23 directly upon the coupling plates 27 and 28 and thus displaces them parallel to one another in such a manner that skewing of the printing plate 42 on the plate cylinder 1 about the pivot point A takes place. Thus skewing of printing plate 42 takes place in a wrinkle-free manner and without imparting unwanted stress to plate 42. This is, in part, possible since the coupling plates 27 and 28 can move both axially and circumferentially on the bottom surface 6 of groove 2.

Figure 4:
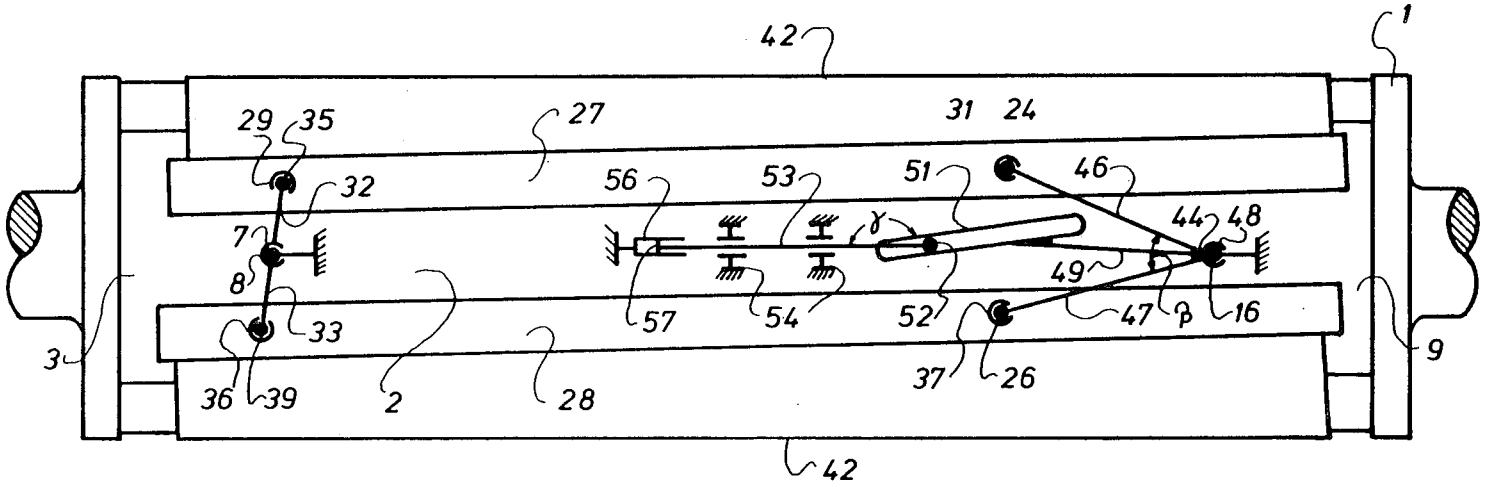
FIG. 4 is a schematic top plan view of a second preferred embodiment of the plate skewing assembly of the present invention.

A second preferred embodiment of the plate skewing assembly is shown schematically in FIG. 4. In this second embodiment, and in the third preferred embodiment shown in FIG. 5 and to be discussed shortly, elements corresponding to the same elements in the first preferred embodiment are given the same numerals. This plate skewing assembly can be utilized during machine operation. A second lever 44 is pivotably supported about the journal 16 in the groove 2. This second lever 44 is embodied with two arms which form lever arms 46 and 47. Both of these lever arms 46 and 47 are located in the same plane and are open relative to one another at an acute angle $\beta$, for example, generally about 40°. The two lever arms 46 and 47 are welded together at one end are provided with a bearing bore 48. An additional, or third lever arm 49, which terminates in a slotted guide 51, is welded to the second two-armed lever 44 at the intersection of the lever arms 46 and 47. The guide 51 is not aligned parallel to the axis of rotation of the plate cylinder 1 but rather is aligned at an angle $\gamma$ of, for example, generally about 15°. The slotted guide 51 receives a guide journal 52 of a push rod 53. The push rod 53 is positioned such that it is displaceable back and forth, generally parallel to the axis of rotation of the plate cylinder 1, in guides 54 which are secured to the groove bottom 6.

Skewing of the plate 42 on plate cylinder 1 by using the second preferred embodiment of the plate skewing assembly of the present invention is accomplished by actuation of a hydraulic or pneumatic adjustment device. As seen in FIG. 4, the push rod 53 is caused to be displaced by a hydraulically or pneumatically actuated working cylinder 56, which is secured on the groove bottom and into which one end, embodied as piston 57, of the push rod 53 extends. The working cylinder 56 can be provided with a suitable pressure medium through lines, not shown, through the cylinder shaft. Upon a displacement of the push rod 53 to the right, the second two-armed lever 44 of the second preferred embodiment undergoes a counterclockwise rotation. This, in turn slides the lower coupling plate 28 to the right, as seen in FIG. 4, and the upper coupling plate 27 to the left thereby effecting a skewing of printing plate 42.

Figure 5:
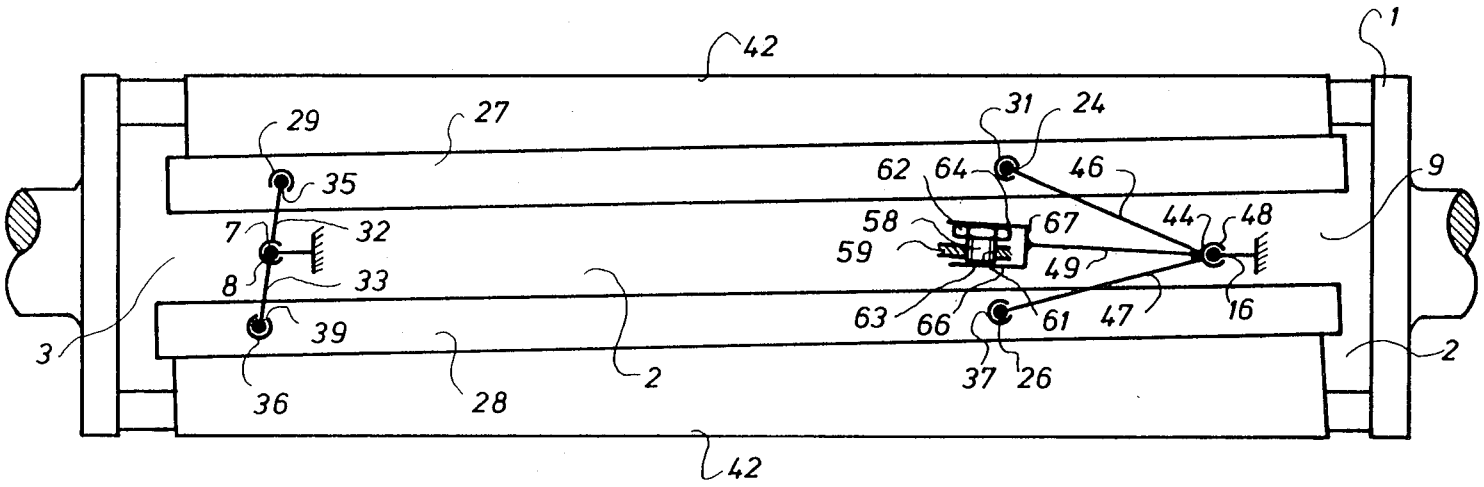
FIG. 5 is a schematic top plan view of a third preferred embodiment of the plate skewing assembly of the present invention.

In the third preferred embodiment, as seen in FIG. 5, the portion of the plate skewing assembly comprising the guide journal 52 and the slotted guide 51, discussed with the second embodiment, is replaced by a screw adjustment assembly which includes a set screw 58 and a fork 67. The set screw 58 is screwed through a bearing block 59, which is secured to the groove bottom 6 in the middle of the groove 2. A threaded bore 61 in the bearing block 59, into which the set screw 58 is screwed, extends transversely to the groove 2 and is oriented generally in the circumferential direction of the plate. The set screw 58 protrudes, with its head 62 and its tip 63, past the bearing block 59, so that an adjustment in both directions is possible. The head 62 and the tip 63 of set screw 58 are encompassed by side walls 64 and 66 of the fork 67, which is welded to the lever 49. Upon clockwise rotation of the set screw 58, the screw tip 63 presses against the first side face 64 of the fork 67 and pivots the two-armed lever 44 counterclockwise. Upon counterclockwise rotation of the set screw 58, the screw head 62 presses against the side face 66 of the fork 67 and pivots the lever 44 clockwise. In a manner similar to the first and second preferred embodiments, these movements are translated into skewing of the printing plate 42 through the clamping plates 27 and 28.

To enable easier displacement of the printing plate 42 on the plate cylinder 1, the surface of the plate cylinder 1 may be equipped with a coating, for example having a relatively low coefficient of friction. The surface of the plate cylinder 1 may also be provided with small bores (not shown) that are connected to a source of compressed air. If the printing plate 42 is to be displaced on the cylinder 1 , after loosening the printing plate 42, compressed air may be blown beneath the printing plate 42 by means of the compressed air source, so that the printing plate can be easily displaced on the circumference of the plate cylinder 1.

While preferred embodiments of a plate skewing assembly in accordance with the present invention have been fully and completely set forth hereinabove, it will be apparent to one of skill in the art that a number of changes in, for example, the specific structure of the printing plate clamping and tensioning devices, the types of journals and bearings used, the overall size of the plate cylinder and the like could be made without departing from the true spirit and scope of the present invention which is, accordingly, to be limited only by the following claims.

What is claimed is:

1. A plate skewing assembly useable to skew a plate carried on a plate cylinder of a rotary printing press, said plate skewing assembly comprising:

first and second generally parallel spaced coupling plates slidably positioned in groove in the plate cylinder, each of said first and second coupling plates carrying a plate clamping and tensioning device;

a first lever pivotably secured at its midpoint in a first end of said groove, said first lever having a first arm pivotably secured to a first end of said first coupling plate and a second arm pivotably secured to a first end of said second coupling plate, wherein a first line of actuation between said midpoint pivot of said first lever and said pivotable connection between said first arm and said first clamping plate is defined as "h" and an extension thereof is defined as "d" and wherein a second line of actuation between said midpoint pivot of said first lever and said pivotable connection between said second arm and said second clamping plate is defined as "f" and an extension thereof is defined as "b";

a second lever pivotably secured at a first end in a second end of said groove, said second lever having a first lever arm pivotably secured to a second end of said first coupling plate and a second lever arm pivotably secured to a second end of said second coupling plate, wherein a third line of actuation between said pivot of said second lever and said pivotable connection between said first lever arm and said first clamping plate is defined as "g" and an extension thereof is defined as "c", and wherein a fourth line of actuation between said pivot of said second lever and said pivotable connection between said second lever arm and said second clamping plate is defined as "e" and an extension thereof is defined as "a"; and means for pivoting at least one of said first and second levers to skew said plate on the plate cylinder and wherein said lines of actuation "e", "f", "g" and "h" and their respective extensions "a", "b", "c" and "d" are disposed at a ratio in which wherein extensions "d" and "c" intersect at a first printing plate pivot point and further wherein extensions "a" and "b" intersect at a second printing plate pivot point.

2. The plate skewing assembly of claim 1 wherein said means for pivoting said at least one of said first and second levers includes a rotatable eccentric.

3. The plate skewing assembly of claim 1 wherein said means for pivoting said at least one of said first and second levers includes a screw adjustment means.

4. The plate skewing assembly of claim 1 wherein said means for pivoting said at least one of said first and second levers includes a fluid pressure actuated adjustment means.

* * * * *

UNITED STATES PATENT AND TRADEMARK OFFICE

CERTIFICATE OF CORRECTION

PATENT NO. : 4,862,800

DATED : September 5, 1989

INVENTOR(S) : Erich Georg Wieland et al

It is certified that error appears in the above-identified patent and that said Letters Patent is hereby corrected as shown below:

Column 6, change claim 1 to read as follows:

--1. A plate skewing assembly useable to skew a plate carried on a plate cylinder of a rotary printing press, said plate skewing assembly comprising:

first and second generally parallel spaced coupling plates slidably positioned in groove in the plate cylinder, each of said first and second coupling plates carrying a plate clamping and tensioning device;

a first lever pivotably secured at its midpoint in a first end of said groove, said first lever having a first arm pivotably secured to a first end of said first coupling plate and a second arm pivotably secured to a first end of said second coupling plate, wherein a first line of actuation between said midpoint pivot of said first lever and said pivotable connection between said first arm and said first clamping plate is defined as "h" and an extension thereof is defined as "d" and wherein a second line of actuation between said midpoint pivot of said first lever It is certified that error appears in the above-identified patent and that said Letters Patent is hereby corrected as shown below:

and said pivotable connection between said second arm and said second clamping plate is defined as "f" and an extension thereof is defined as "b";

a second lever pivotably secured at a first end in a second end of said groove, said second lever having a first lever arm pivotably secured to a second end of said first coupling plate and a second lever arm pivotably secured to a second end of said second coupling plate, wherein a third line of actuation between said pivot of said second lever and said pivotable connection between said first lever arm and said first clamping plate is defined as "g" and an extension thereof is defined as "c", and wherein a fourth line of actuation between said pivot of said second lever and said pivotable connection between said second lever arm and said second clamping plate is defined as "e" and an extension thereof is defined as "a"; and

UNITED STATES PATENT AND TRADEMARK OFFICE

CERTIFICATE OF CORRECTION

PATENT NO. : 4,862,800

DATED : September 5, 1989

INVENTOR(S) : Erich Georg Wieland et al

It is certified that error appears in the above-identified patent and that said Letters Patent is hereby corrected as shown below:

means for pivoting at least one of said first and second levers to skew said plate on the plate cylinder and wherein said lines of actuation "e", "f", "g" and "h" and their respective extensions "a", "b", "c" and "d" are disposed at a ratio in which $$\frac{a + e}{e} = \frac{b + f}{f} = \frac{c + g}{g} = \frac{d + h}{h}$$

wherein extensions "d" and "c" intersect at a first printing plate pivot point and further wherein extensions "a" and "b" intersect at a second printing plate pivot point.--

Signed and Sealed this

Twenty-fourth Day of July, 1990

*Attest:*

HARRY F. MANBECK, JR.

*Attesting Officer*

*Commissioner of Patents and Trademarks*